US005484188A

United States Patent [19]

Stoeckl

[11] Patent Number: 5,484,188

[45] Date of Patent: Jan. 16, 1996

[54] DENTAL PATIENT CHAIR

[75] Inventor: Klaus Stoeckl, Bensheim, Germany

[73] Assignee: Siemens Aktiengesellschaft, Munich, Germany

[21] Appl. No.: 111,418

[22] Filed: Aug. 25, 1993

[30] Foreign Application Priority Data

Sep. 24, 1992 [EP] European Pat. Off. ..... 92116391

[51] Int. Cl.[6] ..... A61G 15/12

[52] U.S. Cl. ..... 297/408; 297/217.3; 297/410

[58] Field of Search ..... 297/330, 391, 297/408, 410, 217.1, 217.3, 362.11

[56] References Cited

U.S. PATENT DOCUMENTS

| | | | |
|---|---|---|---|
| 3,578,379 | 5/1971 | Taylor | 297/391 X |
| 3,984,146 | 10/1976 | Krestel et al. | 297/330 |
| 4,128,797 | 12/1978 | Murata | 297/330 X |
| 5,190,349 | 3/1993 | Austin, Jr. et al. | 297/330 X |
| 5,346,283 | 9/1994 | Steininger et al. | 297/408 |

FOREIGN PATENT DOCUMENTS

| | | | |
|---|---|---|---|
| 0491085 | 6/1992 | European Pat. Off. . | |
| 2912755 | 10/1980 | Germany | 297/330 |
| 3543980 | 6/1987 | Germany | 297/408 |

*Primary Examiner*—Peter R. Brown

*Attorney, Agent, or Firm*—Hill, Steadman & Simpson

[57] ABSTRACT

In a dental patient chair that includes a patient bearing taxonomy in which specific treatment surfaces at teeth of the upper jaw and lower jaw are allocated to specific chair positions, an operating unit having an operating area on which the tooth rows of the upper and lower jaw are displayable as a diagram. The dental diagram is subdivided into a plurality of sections which represent treatment surfaces of those teeth for whose treatment identical or approximately identical chair positions are required. The sections are optically displayable on the operating area. Operating means are allocated to the sections, the adjustment means being activated upon actuation of said operating means for the purpose of adjusting the chair parts into the appertaining, selected chair position. The allocation of the operating means to the sections is defined by their arrangement, by colored or by structured fashioning.

22 Claims, 4 Drawing Sheets

DENTAL PATIENT CHAIR

BACKGROUND OF THE INVENTION

The invention is directed to a dental patient chair having an upper part adjustable in height, a back rest variable in inclination, and a head rest part that can be adjusted relative to the back rest, and that further provides adjustment means having controllable drives for adjusting the chair parts. The adjustment means providing a control means having a plurality of programs selectable with control elements that correspond to different chair positions with reference to the adjustable chair parts, whereby the existing programs include a bearing taxonomy in which specific treatment surfaces at teeth of the upper jaw and lower jaw are allocated to specific chair positions.

Such a patient chair is disclosed, for example, by European Patent Application No. 0 491 085. It is pointed out in this document that there are many recommendations prepared by experienced institutions, in combination with dentists, for supporting a patient or, respectively, for the posture of the attending person in order to enable ergonomically correct working posture. A known and scientifically sound bearing taxonomy was developed by the Arbeitswissenschaftliche Institut of the Technishe Hochschule Darmstadt. In this bearing taxonomy, a specific bearing of the patient and, thus, a specific posture of the attending person as well is allocated to the individual tooth surfaces to be treated. At least 16 additional programs would derive for treatments in the upper jaw and lower jaw. Such a program expansion would necessarily lead to adjustment and programming work for the attending person that would be unmanageable. Additionally, another critical factor is the relatively unsurveyable operation that would derive from such a multitude of programming possibilities.

SUMMARY OF THE INVENTION

The invention is based on the object of achieving a simplification in dental chair operation, particularly in terms of the operation, in comparison to the known dental chairs.

Inventively, those treatment positions of a bearing taxonomy, wherein the adjustment of the chair with reference to the slope of the head rest part and the back rest is the same or approximately the same, are combined. The number of treatment or, respectively, chair positions can thus be reduced to only a few positions that can be surveyed relatively well by an attending person and, thus, can also be well-controlled.

Advantageously, sections or segments of a dental diagram can be displayed on the operating surface of an operating unit. These segments can advantageously contain the operating means such as control panel keys. A further, advantageously designed operating unit contains three respective key fields arranged one above another on the operating surface at both sides of the dental diagram, the two upper keys thereof being allocated to the corresponding segments of the upper jaw, the two lower keys thereof being allocated to the corresponding segments of the lower jaw and the two middle keys thereof being allocated to those segments that have treatment surfaces in the upper and lower jaw that can be treated with the same or approximately the same chair positions.

The objects of the invention are achieved with a dental patient chair having an upper chair part that is at least height-adjustable, a back rest that is at least variable in inclination, a head rest part that is adjustable relative to the back rest, and adjustment means having controllable drives for adjusting the chair parts. A control means is provided having a plurality of selectable programs that correspond to different chair positions with reference to the adjustable chair parts, whereby the programs which include a bearing taxonomy in which specific chair positions are allocated to specific treatment surfaces at teeth of the upper jaw and of the lower jaw can all be modified by an initial setting corresponding to the particular patient and/or dentist.

An operating unit is provided having an operating area on which the tooth rows of the upper jaw and lower jaw are displayed or are displayable as a diagram, whereby the dental diagram is subdivided into a plurality of sections corresponding to the treatment surfaces representing those teeth for whose treatment identical or approximately identical chair positions are required. The sections are optically displayable on the operating area. Furthermore, operating means can be allocated to the sections, the control means being activated upon actuation of said operating means for the purpose of an adjustment of the chair parts into the appertaining chair position, whereby the allocation of the operating means to the sections is defined by their arrangement or by colored or structural shaping.

Further advantages derive from the following description of exemplary embodiments of the invention.

DETAILED DESCRIPTION OF THE PREFERRED EMBODIMENTS

Figure 1:
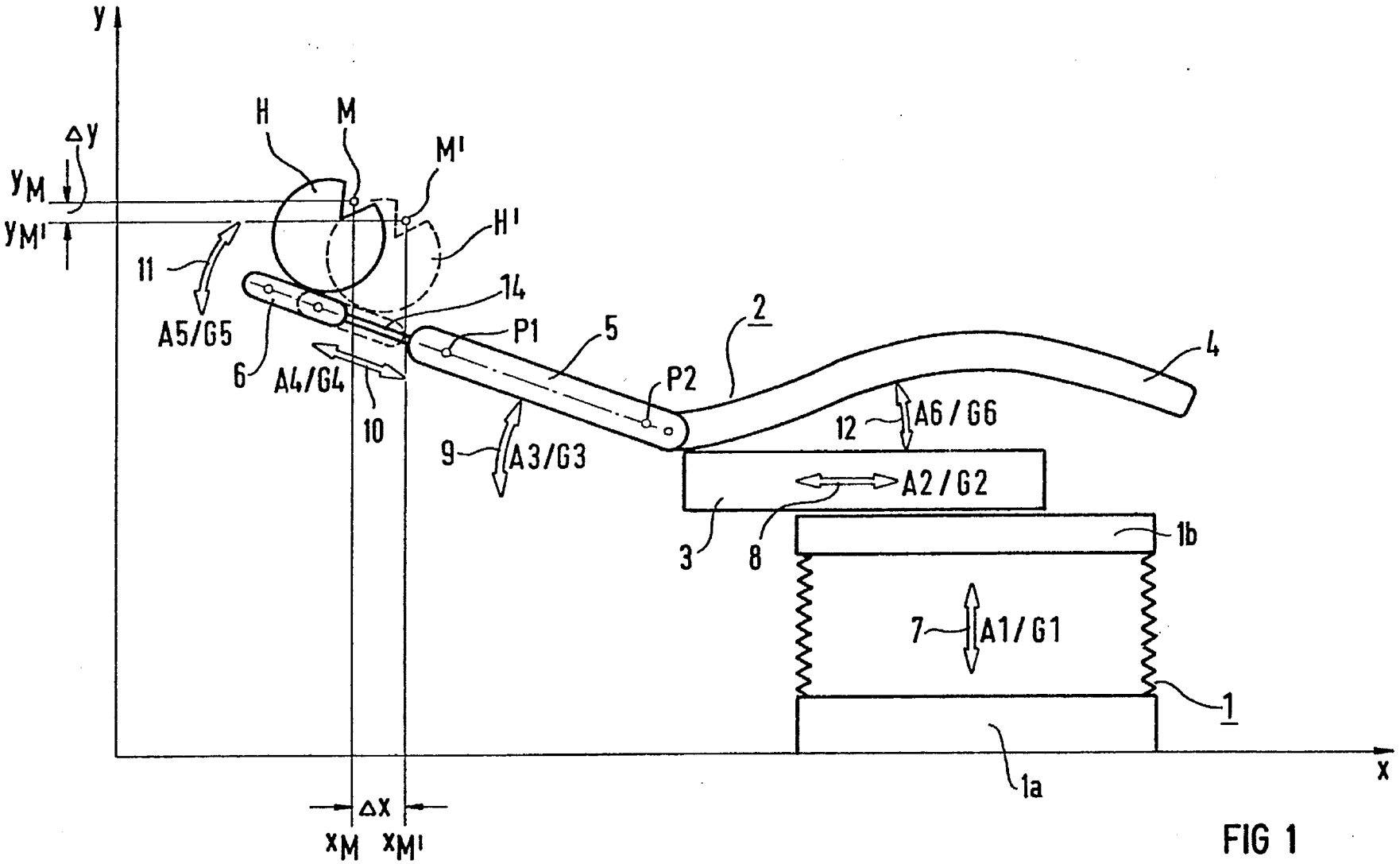
FIG. 1 is a schematic side view of an embodiment of the patient chair of the invention.

In the highly simplified form, FIG. 1 shows a side view of a dental treatment chair. The treatment chair contains a stationary base part 1 holding an upper chair part 2 in height-adjustable fashion. The base part 1 has a pedestal 1*a* and an upper base part 1*b* that is height-adjustable relative thereto. The upper chair part 2 contains a carrier 3 adjustable along the upper base part 1*b* at which a seat 4 and back rest 5 are tiltably held in the direction of arrows 9 and 12. A head rest part 6 is also tiltably and longitudinally displaceably arranged in the direction of arrows 10 and 11 at the back rest 5. In order to adjust the upper chair part 2 in height and in longitudinal direction of the chair as well in the direction of arrows 7 and 8, corresponding, controllable drives A1, A2 are provided. Positioning of the back rest 5 and of the head rest part 6 can be varied by controllable drives A3, A4 and A5 in the direction of the arrows 9, 10 and 11. Since the arrangement of the adjustment drives is known per se, these shall not be presented in greater detail. Both hydraulic as well as pneumatic but preferably electrical drives can be utilized.

Position sensors G1 through G6 with which respective actual positions of the chair parts can be acquired with reference to a horizontal and to a vertical reference plane, are allocated to the adjustable chair parts. The sensors G1, G2 and G4 are linear path sensors; the sensors G3, G5 and G6 are fashioned as angle sensors. The position of the head rest relative to the back rest can be acquired with the assistance of the sensors G4, G5. The adjustment means A4 and A5 can be manually actuatable adjustment means; it is also conceivable and advantageous to also provide electrical adjustment drives here. For adjusting the head rest 6 in the direction of the arrow 10, for example, an adjustment motor can be arranged in the inside of the back rest 5, this adjustment motor adjusting the head rest carrier (brace) referenced 14 via a toothed rack.

With the assistance of the position sensors, the position of the chair parts 2 through 6 can be unambiguously identified with reference to an x/y-coordinate system whose x-axis lies in a horizontal reference plane, preferably in the plane of the floor, and whose y-axis lies in a vertical reference plane, preferably in the plane of a wall of the room from which the base part 1 has a defined spacing. For example, the position of the back rest 5 can be defined with reference to a reference plane by the coordinates of two points that proceed through a straight line proceeding along the back rest and/or by the angle of inclination.

The "mouth point" M of a schematically illustrated "standard patient head" H is the position thereof being defined in the coordinate system by the coordinates $x_M$, $y_M$. The "mouth point", which is intended to represent a point of reference corresponding to a preparation location, can preferably be defined such that it lies on the angle bisector between upper jaw and lower jaw of an open patient mouth and at approximately half the "mouth depth". Proceeding from this "mouth point", a vertical spacing b from the aforementioned plane of the back rest 5 proceeding through the two points P1 and P2 derives. Based on the dimensions of an average patient head (standard patient head) to be empirically calculated, the "mouth point" M can therefore be unambiguously defined in a x/y-coordinate system.

The "mouth point" M can be individually varied in y-direction, for example, can be brought into the position referenced $y_{M1}$. A matching to the physical size of the attending person is advantageously possible on the basis of such a change. When the "mouth point" is varied in y-direction because, for example, the attending person would like to change from a sitting position into a standing treatment position, the new "mouth point" $y_1$ can be advantageously kept given all changes in the inclined attitude of the back rest and/or of the head rest.

The head rest 6 adjustable along the back rest corresponding to the arrow direction 10 makes it possible to match the "mouth point" (M) to different patient sizes, in that given a change of the head rest position for a patient having a different body size— for a smaller patient here according to the position (H') shown with broken lines—the upper chair part, as set forth above, is corrected such by the dimension $\Delta x$ and $\Delta y$ that the "mouth point" M is retained, as a result whereof the attending person need not change his working posture, nor the instruments and devices allocated to him.

Figure 2:
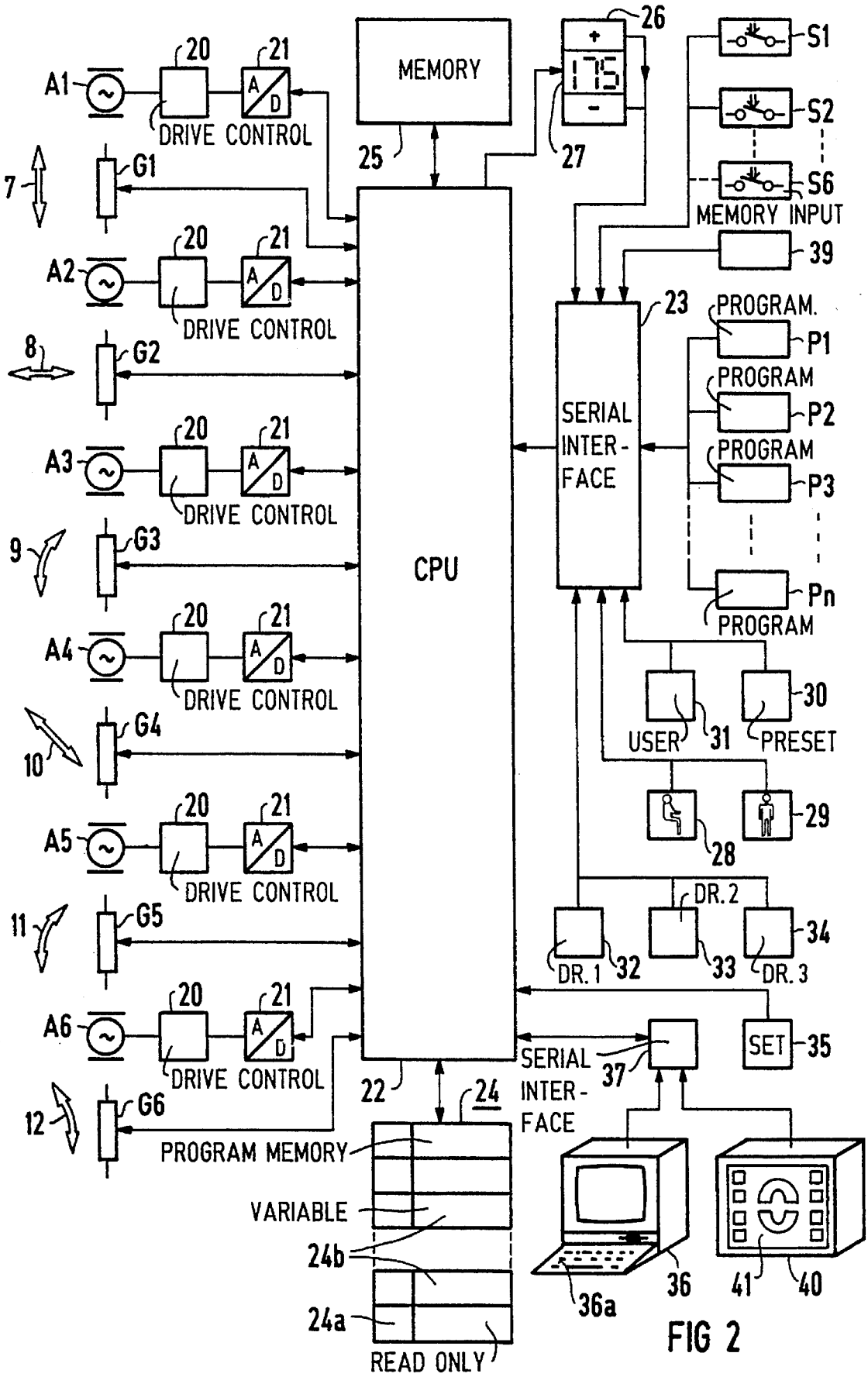
FIG. 2 is a block circuit diagram of a control and calculating unit.

The functioning and further advantages of the chair of the invention are set forth with reference to the block circuit diagram in FIG. 2.

As already presented, the chair—in this embodiment—comprises controllable drives A1 through A6 that are advantageously electromotive drives. The drives are driven by a central unit 22 (CPU) via power output stages 20 and analog-to-digital converters 21. Appropriate sensors G1 through G6 in the form of, for example, potentiometers are provided between the chair parts adjustable relative to one another, i.e., between the pedestal and upper base part, between upper base part and carrier, as well as between seat and back rest and head rest, these sensors supplying a signal to the central unit 22 corresponding to the path of adjustment in accord with their relative position. Corresponding to the controllable drives that are present, switches S1 through S3 are present with which an individual adjustment of the chair parts, for example, a height adjustment or longitudinal displacement of the upper chair part or an inclination of the back rest, can be initiated. The actuation of the drives A1 through A6 ensues via a first serial interface 23, likewise proceeding from the central unit 22.

Program selection keys are referenced P1 through $P_n$, various chair programs being capable of being called in with these program selection keys from a program memory 24 via the serial interface 23 and the central unit 22. These programs are a matter both of variable programs that can be individually input as well as of chair programs from a bearing taxonomy that are permanently prescribed at the factory, whereby quite specific chair positions are allocated to specific tooth treatments according to a strategy produced according to ergonomic considerations. The program memory 24 thereby contains both read-only memories **24*a* as well as variable memories 24*b***.

A memory 25 is provided wherein the x/y-values of the "mouth point" M can be stored as a rated value. This stored rated value can be corrected by a ± input unit 26 via the serial interface 23 in the central unit 22, as was set forth for adaptation to the body size of the attending person, in that the y-value is upwardly or downwardly varied from an average corresponding to an average size. This corrected value is displayed at a display 27 and is automatically taken into consideration when a chair program is called in with the program selection keys $P_1$ through $P_n$.

The individual programs for, on the one hand, a seated, and, on the other hand, for a standing treatment can be suitably selected with the selection keys 28, 29. There is thus a switching possibility to optionally provide the entire bearing taxonomy for the standing or prone treatment. A further selection possibility is provided by the two selection keys 30, 31. Upon actuation of the right-hand key 30, a program prescribed by the manufacturer and read out from the read-only memories **24*a* can be applied, whereas a program individually set by the attending person can take effect given actuation of the left-hand key 31**.

A third selection possibility is established by the three other keys 32 through 34. A matching to different attending persons that potentially work in alternation at the same patient chair can be taken into consideration with these keys. The entire bearing taxonomy is thereby adapted to the input quantities, for example, physical sizes of the attending persons. This can occur in that corresponding rated or correction values are read out from the read-only memories **24*a***.

Advantageously, an anthropometric table is taken into consideration in the control program, i.e., in the program memory 24, a "mouth point" for a standing or sitting treatment being prescribed by this anthropometric table that corresponds to the size of the attending person. This software prescription, however, is not fixed; on the contrary, it can be expediently individually corrected by the attending person according to his personal wishes, insofar as desired.

The working program of the central unit 22 is referenced 35. It is advantageous when various "mouth points" for specific treatments and sizes of attending persons are already prescribed by the manufacturer of the patient chair and are worked into a corresponding program. These prescribed values can be modified by the attending person as needed by overwriting the program 35.

Insofar as the attending person would like to set the rated value for a "mouth point" himself, this setting ensues in the following way:

When the patient has taken his place in the chair, the attending person will bring the chair into a position suitable for the treatment by actuating the keys S1 through S6, in which position the "mouth point", i.e., the center of the preparational location, comes to lie into a working posture that is favorable to him. When this position is reached, the x/y-value is input into the memory 25 as a rated value following a corresponding triggering event via a memory input key 39. The central unit 22 thereby acquires the values calculated by the corresponding sensors G1 through G6, whereby angular values are thereby correspondingly edited in the arithmetic unit of the central unit.

When the attending person changes his working position, for example, from a seated position into a standing position, or it turns out that an attending person having a different physical size is working at the patient chair, then he can intentionally change the y-value of the "mouth point" on the basis of an act of will with the assistance of the input unit 26. With such a variation of the "mouth point", all programs stored in the program memory 24 are then automatically corrected to this "mouth point".

When as already mentioned, the head rest part 6 lies against the back rest and can be displaced along the latter, the position sensor G4 can be formed by suitable pressure-sensitive sensors that output a quantity to the central unit corresponding to the position in accord with the pressing power that the patient head exerts on the head rest part 6.

Position 36 references a data processing system connectable to the CPU via a further serial interface 37 via whose keyboard **36*a* a tooth to be treated can be input. The information obtained in this way is forwarded to the computer of the CPU that, in a comparison with stored values from the read-only memory 24*a*** in which the programs of the bearing taxonomy are stored, decides which chair position is required for the treatment of this tooth and which, after receiving an activation signal, then drives the corresponding program.

The further possibility of selecting specific programs from the stored programs of the bearing taxonomy derives when, as set forth in greater detail below, a control panel having an especially advantageously designed operating area is provided. The control panel 40 shown in FIG. 2 contains an operating area 41 in the form of, for example, a touch screen. This operating area is shown enlarged in FIG. 3. A dental diagram referenced 42 wherein upper jaw OK and lower jaw UK are divided into a plurality of sections 43 through 48 is displayed between two rows of keys comprising the keys P43 through P48 that shall be set forth in greater detail later. With reference to the bearing taxonomy that has already been addressed and based on a single-surface cavity preparation at a prone patient with direct view onto the patient mouth, the control panel 40 is laid out with the perception that a specific patient bearing as well as posture of the attending person is allocated to the individual tooth surfaces to be treated, whereby this allocation is reduced to such an extent that a simple, surveyable operation derives for the attending person.

Figure 3:
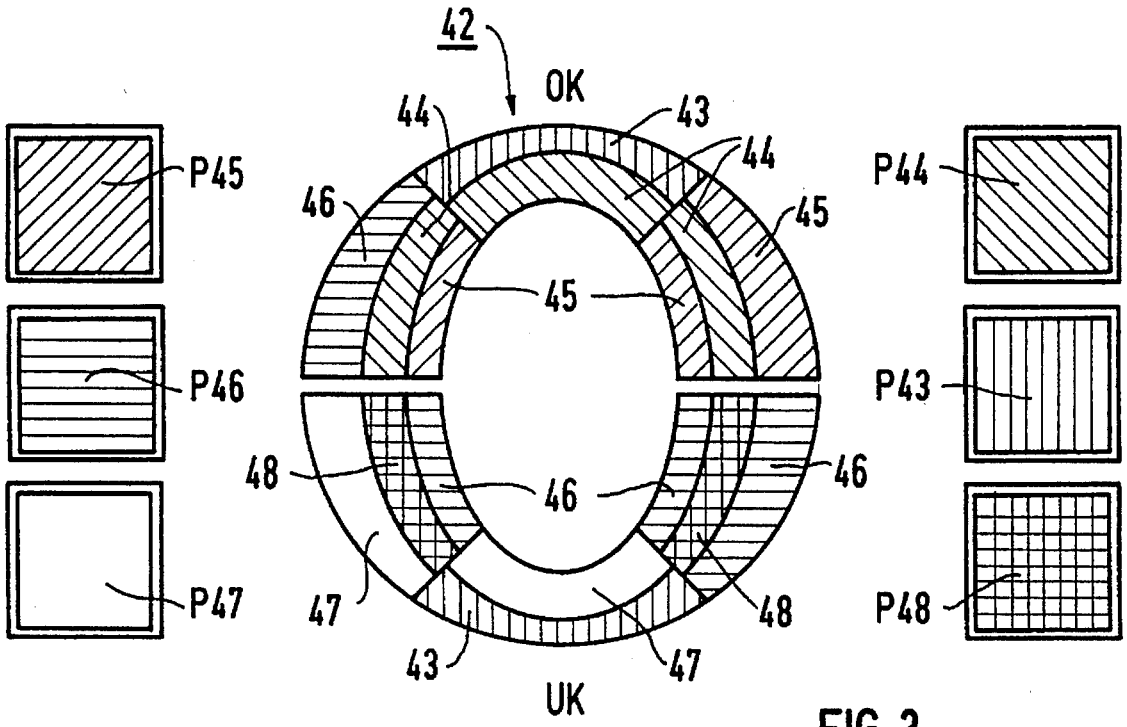
FIG. 3 is a plan view of a first embodiment of an operating unit with operating area.

In the embodiment shown in FIG. 3, the two jaw halves are each respectively subdivided into eight segments, whereby these can in turn be subdivided into three groups or zones with respect to the treatment surfaces, into a first group or zone having oral treatment surfaces, in a second group or zone having buccal treatment surfaces and into a third group or zone having occlusal treatment surfaces, whereby all three groups are represented to the right and left in a region of the side tooth but only oral and buccal treatment surfaces are represented in the front tooth region. A specific chair position is allocated to each segment, this meaning that a quite specific position of the patient and, thus, position of the patient chair is allocated for the treatment of a specific surface (oral, buccal or occlusal) of a tooth.

It has now been found that certain tooth surfaces can be treated with the same patient bearing. For example, the left and right oral surface as well as the right buccal surface in the bicuspid tooth region in the upper jaw can be treated with the same patient bearing. The same is true of the oral surfaces in the front tooth region and of the occlusal surfaces in the bicuspid tooth region.

According to the exemplary embodiment, segments having the same patient bearing are therefore given an identical marking or, respectively, structuring. Appropriate actuation means in the form, for example, of the actuation keys P43 through P48 that are arranged as key fields on the operating area at both sides of the dental diagram 42 are allocated to these.

Six programs of the bearing taxonomy can be selected with only these six actuation means. The allocation can advantageously ensue with a colored identification or—as here in the illustration—by an appropriate shaping or, respectively, structuring of the surfaces when only a black-white surface design is possible, as shown with reference to the example of FIGS. 3 and 4.

It is conceivable in an advantageous modification of the illustrated embodiment to integrate the operation means into the segments or, respectively, to fashion these segments themselves as operating means. One would thus have a direct allocation of the selectable functions to the key surfaces, as a result whereof the surveyability could be even further improved.

Figure 4:
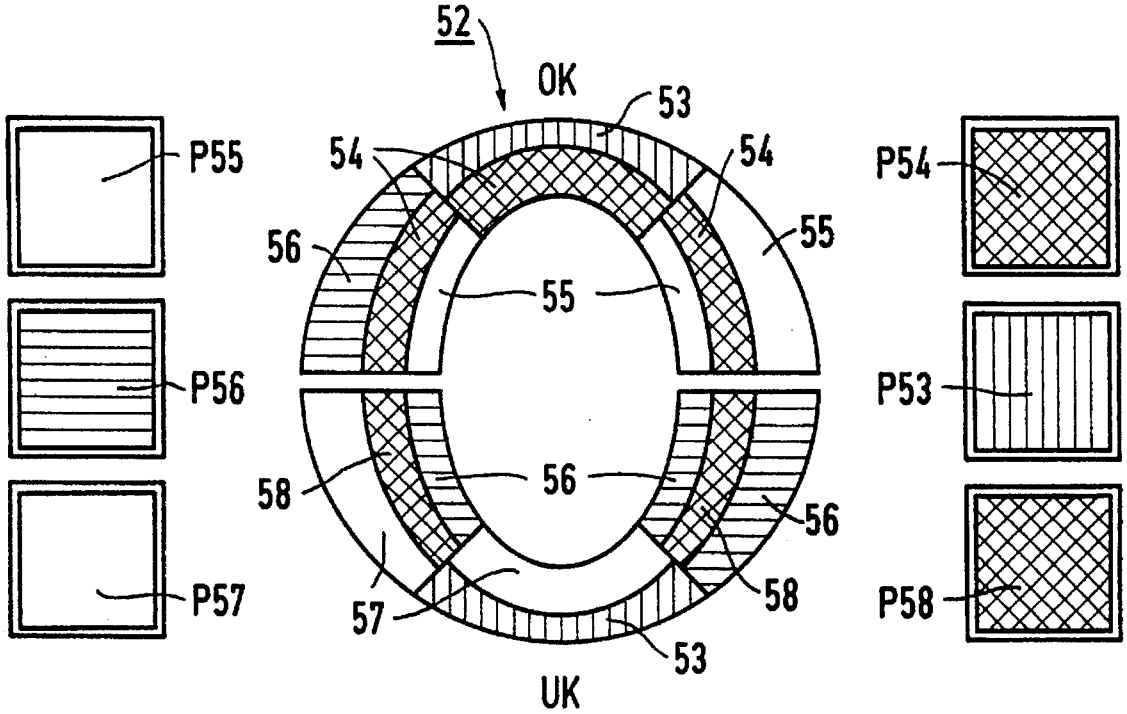
FIGS. 4 and 5 are plan views of further versions of an operating area.

In the version illustrated in FIG. 4, the dental diagram referenced 52 in fact likewise contains eight segments per jaw half; by contrast to the arrangement having six different, structured fields (that can advantageously have a colored substrate) shown in FIG. 3, the allocation herein ensues only with four black-white, structured fields (white field, longitudinally and transversely lined field as well as cross-hatched field). The two upper keys P54 and P55 are thereby allocated to the upper jaw, the two lower keys P57 and P58 are thereby allocated to the lower jaw and the two middle keys P53 and P56 are thereby allocated to the respective dental halves having the same structure.

Figure 5:
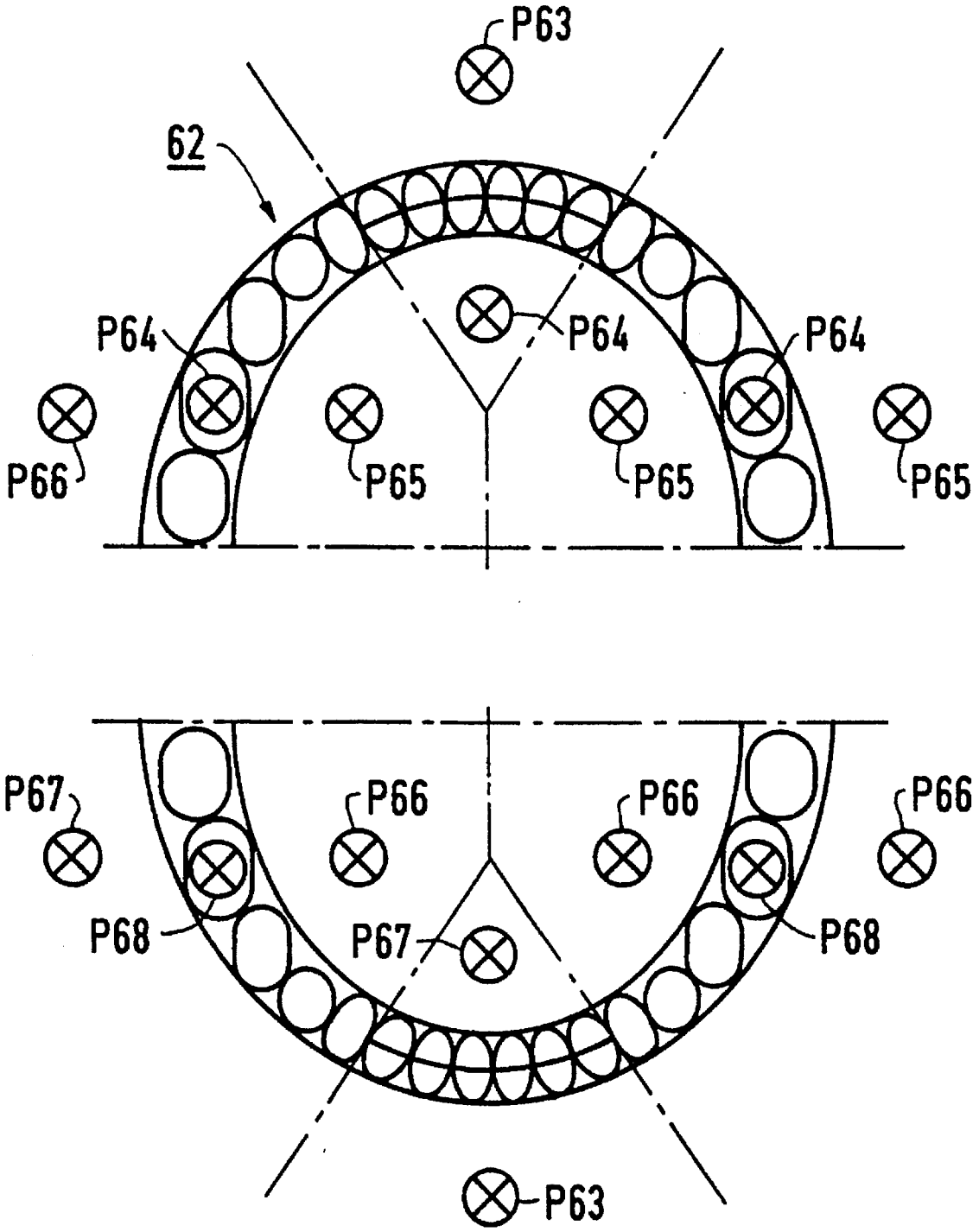

FIG. 5 shows another version wherein a dental diagram 62 is provided which, similar to that set forth above, is subdivided into eight sections. The allocation here is established in that selection keys P63 through P68 are provided immediately adjacent to the treatment surfaces (oral, buccal, occlusal), i.e., in a spatial allocation to the surfaces. The keys are advantageously coupled to corresponding light-emitting means that light up when one of the keys is pressed, as a result whereof the user is given an optical answer or feedback about the selected chair program.

Such an answer is also advantageous in the above-described versions, in that, for example, the operating means or the corresponding segments as well are provided with appropriate light-emitting means.

It is provided in another advantageous version, which likewise lies within the scope of the invention, to define the sections formed—based on the known dental pattern for the teeth—with a tooth or, respectively, number combination in combination with an identifier that defines the treatment surfaces.

Although the present invention has been described with reference to a specific embodiment, those of skill in the art will recognize that changes may be made thereto without departing from the scope and spirit of the invention as set forth in the appended claims.

We claim as our invention:

1. A dental patient chair, comprising:

a lower body rest part that is height-adjustable;

a back rest that is variable in inclination;

a head rest part that is position adjustable relative to the back rest;

adjustment means having controllable drives for position adjusting the lower body rest part, the back rest and the head rest part;

a control means containing a plurality of selectable programs respectively corresponding to different chair positions defined by an adjusted position of the lower body rest part, the back rest, and the head rest part, said different chair positions being allocated to specific treatment surfaces at teeth of the upper jaw and of the lower jaw, for activating the adjustment means according to one of the selectable programs; and an operating unit having an operating area on which the tooth rows of the upper jaw and lower jaw are represented as a diagram, said diagram including two opposed semi-circular arrays representing a patients mouth wherein the semi-circular arrays are divided into a plurality of sections representing specific areas of the teeth, said sections representing teeth for treatment of which approximately identical chair positions are required, means for optically displaying said sections on the operating area, and operating means having selected keys which each directly correlate with one of the sections for activating the control means upon actuation of said operating means to adjust the lower body rest part, the back rest and the head rest part in combination into the chair position represented by a selected section.

2. The dental patient chair according to claim 1, wherein the sections are segments of a dental diagram.

3. The dental patient chair according to claim 2, wherein said selectable keys are arranged at three respective key fields arranged above one another at both sides of the dental diagram, two upper keys thereof being allocated to the segments of the upper jaw; and two lower keys being allocated to the segments of the lower jaw, and two middle keys being allocated to the segments that have treatment surfaces in the upper jaw and lower jaw with approximately the same chair position.

4. The dental patient chair according to claim 1, wherein the sections are formed from a number combination from the diagram of the teeth in combination with a subdivision of the treatment surfaces into oral, buccal and occlusal treatment surfaces.

5. The dental patient chair according to claim 1, wherein the selectable keys are disposed on the sections.

6. The dental patient chair according to claim 1, wherein the selectable keys are disposed adjacent the sections.

7. The dental patient chair according to claim 1, wherein sections to which approximately identical chair positions are allocated are identified by identical colors.

8. The dental patient chair according to claim 1, wherein sections to which approximately identical chair positions are allocated have the same surface structuring.

9. A dental patient chair according to claim 1, further comprising an electronic data processing means having a keyboard for receiving as input the location of the tooth to be treated and the data processing means for activating said control means to activate said adjustment means.

10. The dental patient chair according to claim 1 wherein each selectable key is allocated to at least two sections.

11. A dental chair, comprising:

a patient supporting surface for supporting a patient reclining thereon;

means for adjusting the orientation of the patient supporting surface for selecting an elevation and angle of a patient's mouth;

a control means for activating the means for adjusting to position a patient's mouth according to a selected tooth to be treated in accordance with a preprogrammed positioning instruction;

operating means, having a control board on which rows of teeth of the upper and lower jaw are represented grouped in sections in a diagram including two opposed semi-circular arrays representing a patient's mouth wherein the semi-circular arrays are divided into said sections representing specific areas of teeth and to which operating controls are allocated having selectable keys which each directly correlate with one of said sections for communicating with the control means for selecting a section having said selected tooth to be treated for causing said control means to activate the means for adjusting to set the elevation and angle of a patient's mouth.

12. The dental patient chair according to claim 10, wherein the sections are segments of a dental diagram.

13. The dental patient chair according to claim 10, wherein the sections are subdivided into treatment surfaces corresponding to oral, buccal and occlusal treatment surfaces.

14. The dental patient chair according to claim 12, wherein the operating means comprise control key fields adjacent said sections.

15. The dental patient chair according to claim 14, wherein said selectable keys are arranged at three respective key fields arranged above one another at both sides of the dental diagram, two upper keys thereof being allocated to the segments of the upper jaw; and two lower keys being allocated to the segments of the lower jaw, and two middle keys being allocated to the segments that have treatment surfaces in the upper jaw and lower jaw with approximately the same patient mouth position.

16. The dental patient chair according to claim 10, wherein said selectable keys are disposed on the sections.

17. The dental patient chair according to claim 11, wherein sections to which approximately identical chair positions are allocated are identified by identical colors.

18. The dental patient chair according to claim 11, wherein sections to which approximately identical chair positions are allocated have the same surface structuring.

19. The dental chair according to claim 11, wherein said patient supporting surface comprises a back rest and a head rest part, and said means for adjusting the elevation and angle of the patient's mouth comprises controllable position drives at each of said back rest and said head rest part to adjust the angle and elevation thereof.

20. The dental chair according to claim 19, wherein said control means comprises position sensors for providing a position feedback signal corresponding to the back rest and the head rest part.

21. The dental chair according to claim 20, wherein said preprogrammed positioning instructions are modified by an initial feedback signal from said position sensors corresponding to an initial selected positioning of the patient.

22. The dental chair according to claim 10, wherein each selectable key is allocated to at least two sections of teeth.

* * * * *